United States Patent [19]

Walker

[11] Patent Number: 5,046,221

[45] Date of Patent: Sep. 10, 1991

[54] TIE HOLDER

[76] Inventor: Frank I. Walker, 1141 Locksley, Wyoming, Mich. 49509

[21] Appl. No.: 510,193

[22] Filed: Apr. 16, 1990

[51] Int. Cl.[5] ..... A41D 25/04

[52] U.S. Cl. ..... 24/49 R; 24/49 CF; 24/49 CP

[58] Field of Search ..... 24/49 R, 49 CF, 49 CP, 24/51, 60

[56] References Cited

U.S. PATENT DOCUMENTS

| | | | |
|---|---|---|---|
| 795,315 | 7/1905 | Stanley | 24/104 |
| 1,558,285 | 10/1925 | Raphael . | |
| 1,573,885 | 2/1926 | Weisbaum . | |
| 2,084,503 | 6/1937 | Rogers | 24/49 CF |
| 2,168,946 | 8/1939 | Rogers | 24/49 CF |
| 3,360,800 | 1/1968 | Less | 2/145 |
| 3,399,432 | 9/1968 | Merser | 24/90 |
| 3,400,434 | 9/1968 | Pazeotopoulos | 24/49 CP |
| 3,429,064 | 2/1969 | Davi | 40/20 |
| 3,494,003 | 2/1970 | Bower, Jr. | 24/490 CP |
| 3,765,110 | 10/1973 | Olsen | 40/20 |
| 3,968,544 | 7/1976 | Sinclair | 24/49 CF |
| 4,229,930 | 10/1980 | Ostermaier | 54/79 |
| 4,347,932 | 9/1982 | Furutu | 206/343 |
| 4,554,710 | 11/1985 | Grant | 24/49 CF |

*Primary Examiner*—Victor N. Sakran

*Attorney, Agent, or Firm*—Price, Heneveld, Cooper, DeWitt & Litton

[57] ABSTRACT

A necktie holder comprising a flexible filament with two end portions, one of said end portions being affixed to the decorative strip of fabric on the back of the necktie and the other of the end portions being intended to be secured in the nearest adjacent buttonhole on a shirt front.

7 Claims, 1 Drawing Sheet

TIE HOLDER

BACKGROUND OF THE INVENTION

This invention relates to a device for holding a necktie in place adjacent the wearer's shirt front. The concept of a device to hold a necktie in place is well-known (see U.S. Pat. No. 3,360,800). Current necktie holding devices sometimes require the piercing of the necktie with some sharp implement to set the necktie holding device all the way through the necktie where it is held by a clip on a flexible chain. This piercing of the necktie can cause tearing and/or other ripping of the necktie causing damage to the fabric and rendering the necktie unwearable. Furthermore, many neckties worn by today's fashion conscious men have attractive patterns on their outer surfaces, which inspire the wearer of the necktie to want to display the necktie without having the front of the necktie partially covered by a necktie holding device.

SUMMARY OF THE INVENTION

The present invention solves many of the aforementioned problems because the necktie holder is not visible on the front surface of the necktie; rather the necktie holder is affixed on the back surface of the necktie, i.e., the holder being affixed to the strip of fabric described as the decorative (or advertising) loop which is a common feature on neckties currently sold. All the embodiments of the present invention have a flexible length of filament linking two end portions, with one end portion being affixed in some manner to the decorative strip of fabric on the back of the tie and the other end portion being affixed to the shirt front by placing the second end portion through the nearest adjacent buttonhole corresponding to the level of the decorative strip of fabric. There is sufficient length of filament between the two end portions of the necktie holder such that the necktie is retained adjacent the wearer's shirt front while still allowing the necktie to move upwardly and downwardly relative to the shirt front in accordance with movement of the wearer's body.

Depending on the embodiment of the present invention, the end of the tie holding device affixed to the decorative strip of fabric on the back of the tie is either permanently affixed in one of several ways or is detachably affixed in such a way that it takes upward or downward force on the end portion affixed to the decorative strip of fabric in order to detach it therefrom. The tie holding device can be made of plastic, metal, or any other suitable material. It can also be made of several connected pieces. It is preferred to make it of one piece. In the case of those tie holders permanently affixed to the decorative strip of fabric on the back of the tie, the tie holder should be made of material or materials compatible with cleaning solutions (i.e., dry cleaning solutions and/or soap and water) such that when the necktie is cleaned the tie holder is not adversely affected.

BRIEF DESCRIPTION OF THE PREFERRED EMBODIMENTS

Figure 1:
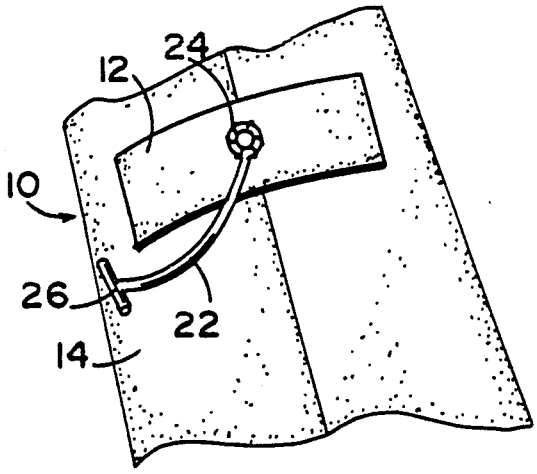
FIG. 1 is a perspective rear view of a necktie showing the manner in which the first embodiment of the tie holder is affixed to the decorative strip of fabric of the tie.
Figure 4:
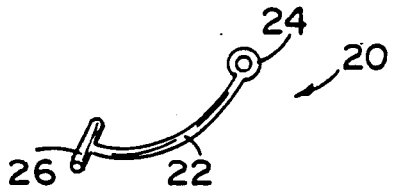
FIG. 4 is a perspective view of the first embodiment of the tie holder, removed from the tie.

In the first embodiment (FIGS. 1 and 4) necktie 10 has a decorative strip of fabric 12 affixed to the back 14 of the tie. Tie holder 20 consists of a long filament 22 with two end portions 24 and 26. End portion 26 consists of a short rod of material on the end of filament 22. End portion 24 consists of a circular member with an aperture in the center. End portion 24 is affixed permanently, in some manner such as gluing or sewing, to decorative strip of fabric 12 on the back 14 of necktie 10. End portion 26 remains unattached. When necktie 10 is worn the wearer slips end portion 26 into the nearest adjacent buttonhole on the shirt front of the wearer. The necktie 10 is free to move in a vertical manner in accordance with movement of the wearer's body.

Figure 2:
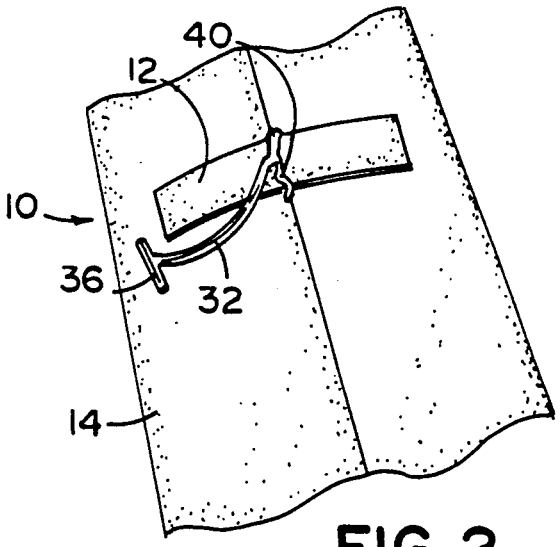
FIG. 2 is a perspective rear view of a necktie showing the manner in which the second embodiment of the tie holder is affixed to the decorative strip of fabric of the tie.
Figure 5:
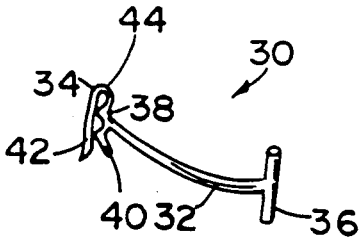
FIG. 5 is a perspective view of the second embodiment of the tie holder, removed from the tie.

In the second embodiment of the present invention (FIGS. 2 and 5) tie holder 30 consists of filament 32 connected to end portion 34 and end portion 36. End portion 34 consists of a U-shaped clip-like member connected to filament 22 at juncture 38. Juncture 38 is on the rough prong 40 of U-shaped member 34, prong 40 being the prong that has two or more curves in it. End portion 34 also has a prong 42 which prong is straight and flat and of a length comparable to the length of rough prong 40. Prongs 40 and 42 are joined by rounded portion 44 such that decorative strip of fabric 12 can be held between prongs 42 and 40. The juncture point 38 is on the rough prong 40 of end portion 34, such that when necktie holder 30 is affixed to decorative strip of fabric 12 by sliding decorative strip of fabric 12 between prongs 42 and 40, prong 42 (the straight flat prong) fits smoothly between the decorative strip and the back of necktie 10. Once end portion 34 is detachably secured to decorative strip of fabric 12, end portion 36, which consists of a solid rod of material at the end of filament 32 can then be inserted into the nearest adjacent buttonhole. Tie holder 30 can either be left in place on the back 14 of necktie 10 or it can be detached from decorative strip of fabric 12 by merely sliding end portion 34 upwardly to detach it from decorative strip of fabric 12. Since there is ample slack in fabric loop 12, the filament 32 of the necktie holding device can be attached to straight prong 42 with the contacting shaped prong being fitted inside the loop.

Figure 3:
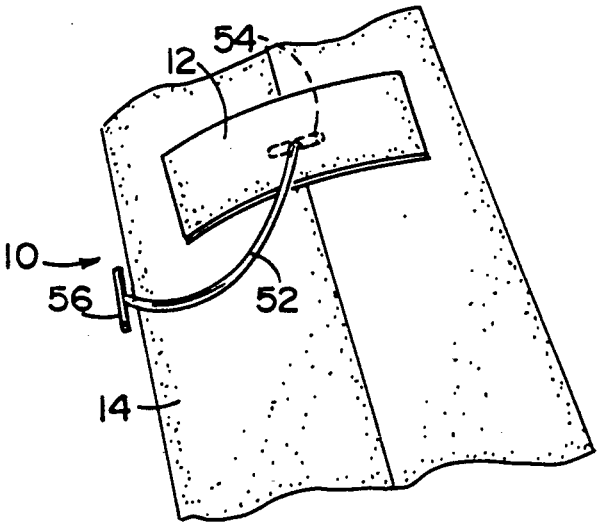
FIG. 3 is a perspective rear view of a necktie showing the manner in which the third embodiment of the tie holder is affixed to the decorative strip of fabric of the tie.
Figure 6:
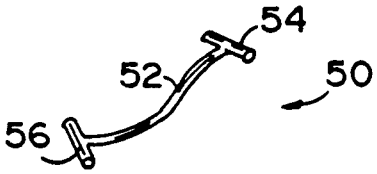
FIG. 6 is a perspective view of the third embodiment of the tie holder, removed from the tie.

In the third and preferred embodiment of the present invention (FIGS. 3 and 6) necktie holder 50 consists of filament 52 connected to end portion 54 and end portion 56. In this embodiment, both end portions 54 and 56 can be identical, consisting of a short rod of material affixed to filament 52 in a perpendicular manner. In using tie holder 50 on necktie 10, either one of the end portions 54 or 56 is permanently affixed to decorative strip of fabric 12 by inserting the end portion through the material of decorative strip 12 leaving filament 52 extending with end 56 exposed for insertion in a buttonhole on a shirt.

In all of the above embodiments of the present invention, the filament connecting the two end portions in each necktie holders is preferably between 1½ and 2½ inches long, with 2 inches being preferred. The material that the necktie holders are made of can vary depending upon the tastes of the necktie wearer. It can be made of plastic (such as polyethylene) or it can be made of metal, with a flexible chain or wire, or even some sort of fabric. The preferred material is a plastic or polymeric material which can be formed through conventional plastic molding techniques. As stated before, the necktie holders that are permanently affixed to the necktie (the first and third embodiments illustrated in FIGS. 1 and 3) should be made out of material compatible with dry cleaning solutions or soap and water.

The wearer of the necktie usually inserts the small end of the tie through the decorative loop after the knot is completed. The tie holders of the present invention are small and unobtrusive enough to be left in place at all times without interfering with the necktie tying procedure.

These and other objects and benefits of the invention will be more clearly understood with reference to the attached drawings and appended claims. This description of the preferred embodiments is not intended to be a limitation on any obvious and expected variations of the above-described invention.

The embodiments of the invention in which an exclusive property or privilege is claimed are defined as follows:

1. A one piece device for holding a necktie in place, comprising:

a filament portion with a first and a second end portion;

said first end portion being a detachable clip for grasping the decorative strip on the back of a necktie said detachable clip portion comprises a U-shaped member having first and a second prong, said first prong of said U-shaped member having a flat surface and the said second prong of said U-shaped member having a configured surface for cooperating with said first prong in gripping the decorative loop on the back of said tie; and said second end portion member being a rod-like member for attachment to the shirt front of the necktie wearer by inserting said second portion through a buttonhole.

2. The necktie holder of claim 1 in which said necktie holder is made of plastic.

3. The necktie holder of claim 1 in which said necktie holder is made of metal.

4. A device for holding a necktie in place, comprising:

a filament with a first and a second end portion;

said first end portion is for affixing to the decorative strip of fabric on the back of the necktie; said first end portion comprising a round member with an aperture in the center of said member;

said second end portion comprising a rod of material secured to said filament in a perpendicular manner; said second end portion is for attachment to the shirt front of the necktie wearer by inserting said second end portion through a buttonhole.

5. The necktie holder of claim 4 in which said necktie holder is made of plastic.

6. The necktie holder of claim 4 in which said necktie holder is made of fabric.

7. The necktie holder of claim 4 in which said necktie holder is made of metal.

* * * * *